US008590122B2

(12) United States Patent
West et al.

(10) Patent No.: US 8,590,122 B2
(45) Date of Patent: Nov. 26, 2013

(54) METHOD AND APPARATUS FOR COMPACTING TUBULAR FABRICS

(75) Inventors: Mark Troy West, Charlotte, NC (US); Barry Defoy Miller, Lexington, NC (US); Jerry Wayne Pendleton, Bessemer City, NC (US)

(73) Assignee: Tubular Textile Machinery, Inc., Lexington, NC (US)

( * ) Notice: Subject to any disclaimer, the term of this patent is extended or adjusted under 35 U.S.C. 154(b) by 49 days.

(21) Appl. No.: 13/415,460

(22) Filed: Mar. 8, 2012

(65) Prior Publication Data

US 2012/0233826 A1 Sep. 20, 2012

Related U.S. Application Data

(60) Provisional application No. 61/453,830, filed on Mar. 17, 2011.

(51) Int. Cl.
*D06C 21/00* (2006.01)

(52) U.S. Cl.
USPC ..... 26/18.6

(58) Field of Classification Search
USPC ..... 26/18.6, 80, 81, 18.5; 28/142, 165, 167
See application file for complete search history.

(56) References Cited

U.S. PATENT DOCUMENTS

| | | | | |
|---|---|---|---|---|
| 2,228,001 | A | 1/1941 | Cohn et al. | |
| 2,263,712 | A | 11/1941 | Wrigley et al. | |
| 3,015,145 | A | 1/1962 | Cohn et al. | |
| 3,015,146 | A | 1/1962 | Cohn et al. | |
| 3,083,435 | A * | 4/1963 | Cohn et al. | 26/18.6 |
| 3,195,212 | A * | 7/1965 | Wehrmann | 26/18.6 |
| 3,471,907 | A | 10/1969 | Beckers | |
| 3,973,303 | A | 8/1976 | Diggle, Jr. | |
| 4,142,278 | A * | 3/1979 | Walton et al. | 26/18.6 |
| 4,227,288 | A * | 10/1980 | Moser | 26/18.6 |
| 4,562,627 | A | 1/1986 | Milligan | |
| 4,882,819 | A | 11/1989 | Milligan et al. | |
| 5,012,562 | A * | 5/1991 | Catallo | 26/18.6 |
| 5,016,329 | A | 5/1991 | Milligan et al. | |
| 5,026,329 | A | 6/1991 | Diekevers | |
| 5,553,365 | A * | 9/1996 | Catallo | 26/18.6 |
| 5,655,275 | A | 8/1997 | Allison et al. | |
| 6,047,483 | A | 4/2000 | Allison et al. | |
| 6,681,461 | B1 * | 1/2004 | Catallo | 26/18.6 |

OTHER PUBLICATIONS

International Search Report and Written Opinion of the International Searching Authority; Application No. PCT/US2012/028681; Issued: Jul. 2, 2012; Mailing Date: Jul. 9, 2012; 13 pages.

* cited by examiner

*Primary Examiner* — Amy Vanatta
(74) *Attorney, Agent, or Firm* — St. Onge Steward Johnston & Reens LLC

(57) ABSTRACT

A two-stage process and apparatus for compacting tubular knitted fabrics, wherein at each stage the fabric, is acted upon by cooperating feeding and retarding rollers spaced apart a distance greater than the thickness of the fabric. Opposite fabric sides thus cannot be in simultaneous contact with the feeding and retarding rollers at the same point along the fabric. Fabric is transferred from a feed roller to a retarding roller while opposite sides of the fabric are closely confined in a compacting zone, free of contact with either roller. Fabric is longitudinally compacted during its traverse of that zone. In the second stage, the rollers are reversely oriented with respect the fabric. Unlike known two-stage procedures, not more than 60% of the compacting effort is imparted in either one of the stages. Preferably each stage imparts about 50% of the compacting effort. Higher production speeds and superior product quality are achieved.

11 Claims, 5 Drawing Sheets

METHOD AND APPARATUS FOR COMPACTING TUBULAR FABRICS

CROSS-REFERENCE TO RELATED APPLICATIONS

The present application claims the benefit under 35 U.S.C. §119(e) of the U.S. Provisional Patent Application Ser. No. 61/453,830, filed on Mar. 17, 2011, the content of which is incorporated herein by reference.

FIELD OF THE INVENTION

The invention relates to the finishing treatment of tubular knitted fabrics and more particularly to novel and improved processes and equipment for the longitudinal compressive shrinking (compacting) of such fabrics during finishing treatment to minimize shrinkage of the fabrics when the fabrics, after being converted into garments, are subjected to washing and drying.

BACKGROUND OF THE INVENTION

Knitted fabrics, and particularly tubular knitted fabrics, are favored for their comfort, stretchiness and related characteristics resulting from the knitted construction thereof, wherein the fabric is comprised of a series of laterally and longitudinally interconnected loops. Tubular knitted fabric is produced on circular knitting machines, which construct the fabric in continuous lengths. Segments of substantial length are gathered into rolls as they exit the knitting machine and are periodically severed and removed for processing.

Tubular knitted fabric from the knitting machines typically is processed in substantially continuous lengths and can be subjected to various treatments, such as washing, bleaching, dyeing, drying, etc. In many of these operations the fabric is placed under longitudinal tension, frequently while wet. At the end of such processing the fabric typically will have been elongated significantly, and correspondingly narrowed in width because of its interlocking loop construction. It is accordingly necessary to subject the fabric to certain finishing operations, in order to restore the fabric to suitable finished length and width conditions and stabilize its geometry. This enables the fabric to be formed into garments that will not shrink excessively, particularly in the length dimension, when subjected to typical washing and drying operations.

One of the known procedures for stabilizing knitted fabrics is by mechanical compacting in the length direction. An early machine for this purpose, developed in the late 1950s and disclosed in the Cohn et al U.S. Pat. No. 3,015,145, utilizes an opposed pair of cooperating rollers forming a nip. A feed roller is driven at a first surface speed and a retarding roller is driven at a second and slightly slower surface speed. The tubular knitted fabric, in flat, two-layer form, is advanced by the feed roller while being confined against the surface of the feed roller by an arcuately contoured shoe. The confining shoe has a sharply pointed tip positioned slightly (e.g., one-eighth to one-fourth inch) "upstream" from the nip formed by the two rollers. The arrangement is such that the fabric is advanced toward the nip by the feed roller, at the surface speed of the feed roller. When the fabric reaches the nip, it is in simultaneous contact with both rollers and is decelerated by the retarding roller, substantially to the slower surface speed thereof, causing the fabric to be compressively compacted in a lengthwise direction in the small space between the tip of the shoe and the roller nip. Heat and moisture are applied to the fabric during the processing thereof.

The procedure of the Cohn et al '145 patent, while very efficient in compressively shrinking the fabric, has the drawback of acting differentially on the opposite sides of the flat tubular fabric as the fabric passes through the roller nip in simultaneous contact with two rollers operating at different surface speeds at the same point along the fabric length. This gives the tubular fabric a somewhat different appearance on opposite sides. In this connection, the opposite sides of a flat tubular fabric constitute the same (e.g., outside) surface of a garment made from the fabric and any differential surface appearance on different parts of that surface may be readily apparent to the observer.

In an effort to minimize differential surface appearances, the procedure of the Cohn et al U.S. Pat. No. 3,015,146 was developed, which involves passing the flat, tubular knitted fabric through two compacting stations in succession, with the respective stations being reversely oriented with respect to surfaces of the fabric. In this procedure, the fabric is still subjected to simultaneous differential speed roller contact at the respective roller nips. It was hoped that differential treatment at the first station would be offset by an opposite differential treatment at the second station. While this procedure helped, it did not eliminate the problem of differential surface appearance on opposite sides of the fabric. In this process, it was typical for the majority (e.g., 80%) of the total compacting to be imparted to the fabric in the first station, and a much smaller amount to be imparted in the second station. In the above-described process it is also desirable to elongate the fabric slightly between the first and second compacting stages.

A further improvement in equipment and procedures for processing of tubular knitted fabric, developed in the late 1980s, is represented by the Milligan et al U.S. Pat. Nos. 4,882,819 and 5,026,329. In that procedure, there are opposed feeding and retarding rollers driven at different surface speeds, but the rollers are spaced apart a short distance (e.g., one-eighth inch) and do not form a nip. Instead, a pair of opposed, fabric confining blades extend from above and below the two rollers into the narrowest portion of the space between the rollers. The end extremities of the respective blades are opposed and are closely spaced in order to define a narrow confinement zone extending at an angle from one roller to the other. Fabric is driven toward the confinement zone at the surface speed of the feed roller, passes through the confinement zone, and is discharged onto the surface of the retarding roller, operating at a slower surface speed than the feed roller. The fabric is decelerated from the faster speed to the slower speed while being closely confined top and bottom in the confinement zone, and the compacting is imparted to the fabric while the fabric is in that zone. This procedure has a significant advantage over that of the earlier Cohn el al patents in that the fabric is never simultaneously contacted at the same point by the feeding and retarding rollers.

SUMMARY OF THE INVENTION

The procedures of the Milligan et al '819 and '329 patents, represented a major improvement over the procedures of the Cohn et al '145 and '146 patents and have been an industry standard for over twenty years. Nevertheless, we have found, quite surprisingly, that under proper conditions, still further and very significant improvements in the overall compressive shrinkage process could be achieved by, among other things, arranging the Milligan et al '329 type compressive shrinkage equipment in two closely spaced and reversely oriented stations, even though the Milligan et al equipment does not involve simultaneously contacting the fabric at the same point with rollers operating at different surface speeds. In the process of the invention, the tubular knitted fabric, after being spread to flat form and predetermined width and steamed, is passed successively through first and second reversely oriented compacting stages. Unlike the procedure of the Cohn et al '146 patent, however, the successive stages in the new procedure are operated to impart substantially equal amounts of compacting to the fabric at each stage, as compared to the earlier procedures in which the great majority of the total shrinkage (e.g., 80%) was imparted at the first stage. In the new procedure, there can be limited variation in the amount of compacting at each stage, for example 50%-60% at the first stage and 40%-50% at the second stage. However, the preferred and targeted operation is to perform approximately 50% of the compacting at each of the two stages.

Surprisingly, the process of the invention results in very significant improvement in operating efficiencies and performance of the overall finish processing of tubular knitted fabric. In this respect, for a given level of total compacting, the procedure of the present invention can achieve an increase in production speeds of up to 25%, and potentially more depending on the particular fabrics.

Typically, tubular knitted fabrics are run through dryers at the completion of initial processing and shortly before the compacting operations. Under current practices, many operators significantly overfeed the fabric into the dryer in an effort to obtain some of the desired lengthwise shrinkage in the dryer itself and thus reduce the compacting effort required at the subsequent compacting stage. However, such overfeeding requires lower production speeds at the dryer. With the compacting procedure of the invention, both higher compacting levels and greater rates of production are attainable at the compactor stage, without compromising the fabric, thus enabling the factory dryers to be run with less overfeed and higher throughput. In addition to the above described operating improvements, the process of the invention achieves significant improvements in product appearance and quality.

For a better understanding of the above and other objects and advantages of the invention, reference should be made to the following detailed description of a preferred embodiment and to the accompanying drawings.

DETAILED DESCRIPTION OF THE INVENTION

Figure 1:
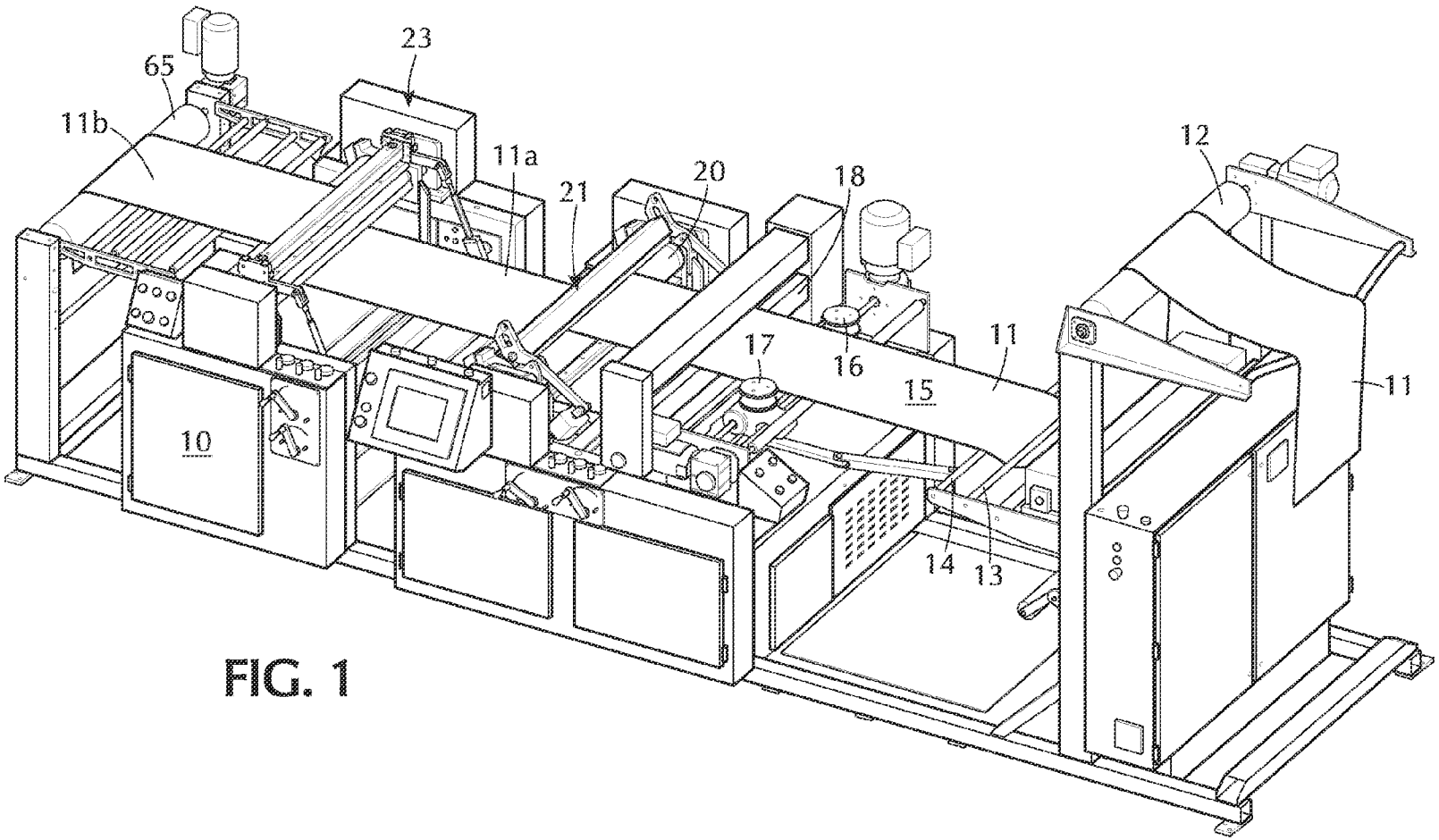
FIG. 1 is a perspective view from above of a two-stage compacting system according to the invention for processing tubular knitted fabrics.

Referring now to the drawings, the reference numeral 10 designates generally a two-stage compacting system according to the invention. An incoming web 11 of tubular knitted fabric, from a supply thereof (not shown), is led over a driven entry roller 12, and around guide bars 13, 14 to the entry end of a laterally adjustable spreader mechanism 15. The spreader mechanism includes a frame (not shown) which is contained within the tubular fabric and is supported and driven externally by spaced apart edge drive rollers 16, 17. The spreader mechanism, in itself well known, may be of a type as generally represented by the S. Cohn et al U.S. Pat. No. 2,228,001, the disclosure of which is incorporated herein by reference. The tubular knitted fabric is advanced over the spreader and distended laterally as necessary to achieve a predetermined, uniform width. While still on the downstream portion of the spreader the fabric is steamed on its top and bottom sides by steam boxes 18, in order to moisten and lubricate the fabric to be receptive to the compacting operations which immediately follow.

The downstream end 19 of the spreader 15 is positioned to be closely adjacent to, a feed roller 20 of a first station compactor 21, to be described hereinafter. In the compactor 21, the fabric is acted upon in succession by the feed roller 20 and then by a retarding roller 22 and subjected to a predetermined and controllable degree of lengthwise compressive shrinkage. In the first stage compactor, the feed roller acts upon the bottom surface of the fabric tube and, after transfer of the fabric through a short, confined, compacting zone, the retarding roller acts upon the top surface of the fabric.

Partially compacted fabric 11*a*, exiting from the first stage retarding roller 22 is conveyed in a tension-free manner to a second stage compactor 23, where the upper surface of the fabric tube is brought into contact with a feed roller 24 of a second stage compactor 25. The second stage compactor is reversely oriented in relation to the first stage compactor 21 and includes a second stage retarding roller 26 arranged to contact the bottom surface of the fabric tube. Fabric passing through the second stage compactor is subjected to a second stage of compressive shrinkage, preferably in an amount substantially equal to that imparted to the fabric in the first stage. After the second stage of compacting, the fabric 11*b* is conveyed over an exit roller 65 and gathered, typically by folding or rolling.

Pursuant to the invention, a preferred form of compacting station is of the type disclosed in the before mentioned Milligan et al U.S. Pat. Nos. 4,882,819 and 5,016,329, the entire contents of which are incorporated herein by reference. Pertinent aspects of the preferred form of compacting station are shown in FIG. 4, which is oriented to correspond with the orientation of the first stage compactor 21 of FIGS. 1 and 2, it being understood that the second stage compactor 23 can be of substantially identical construction but reversely oriented. The feed roller 20 advantageously is an elongated metal cylinder mounted at opposite ends for rotation about an axis and controllably driven for variable speed operation by a drive 26, symbolically shown in FIG. 3. The outer surface of the feed roller 20 may be sandblasted or otherwise treated to enable it to grip and advance a fabric tube 11 in the manner desired. The retarding roller 22 is mounted in parallel to the feed roller 20 and is connected to a variable speed drive symbolically indicated at 27 in FIG. 3. The retarding roller 22 advantageously is constructed of a metal cylinder 28, which is surrounded by a resilient surface layer 29. The arrangement of the feed and retarding rollers 20, 22 is such that the outer surfaces thereof, as they most closely approach each other, are spaced apart a distance substantially greater than the thickness of the tubular fabric, for example a spacing of approximately one-eighth inch.

As shown in FIG. 4, an arcuately contoured confining shoe 30, mounted by a rigid bar structure 31, has an undersurface 32 shaped to conform closely to the surface of the feed roller 20 to confine the incoming fabric 11 and cause it to travel with the moving surface of the feed roller. At its forward, lower edge, the confining shoe 30 mounts an upper or feeding side blade member 33. The front surface 34 of the blade forms a continuation of the arcuate surface 32 of the shoe 30 while the back surface 35 is shaped to taper the lower portion of the blade and enable it to extend deeply between the rollers 20, 22. The lower extremity 36 of the blade 33 is disposed at an angle of about 45° to a plane containing the axes of the rollers 20, 22 and forms the top of a fabric confinement zone 37.

A lower or retarding side blade 38 is rigidly secured to a mounting shoe 39 and extends upwardly into the space between the rollers 20, 22. The back face 40 of the lower blade 38 is arcuately contoured to conform closely to the outer surface of the retarding roller 22 and the front face 41 is shaped to taper the blade and enable it to extend upward between the two rollers. The upper extremity of the blade 38 is formed with a surface 42 which is disposed at a 45° angle to lie parallel with the end surface 36 of the upper blade and thus to define the bottom of the confinement zone 37.

As described in the Milligan et al '819 and '329 patents, tubular knitted fabric approaching the compacting station is engaged by the feed roller 20 and is confined against the surface thereof by the arcuate shoe surface 32 and the arcuate portion 34 of the feeding side blade 33. When the advancing fabric reaches the upper extremity of the retarding side blade 38, the fabric is redirected from the surface of the feed roller 20 into the confinement zone 37. The fabric passes through the confinement zone while being closely confined top and bottom by the opposed end surfaces 36, 42 of the respective upper and lower blades 33, 38. As the fabric is discharged from the zone 37 it is immediately engaged by the outer surface 29 of the retarding roller 22 and conveyed away at the surface speed of the retarding roller, while being confined against the surface of the retarding roller by the arcuate back surface of the retarding side blade 38.

In the short space defined by the confinement zone 37, the longitudinal advance of the fabric is decelerated from the surface speed of the feed roller 20 to the slower surface speed of the retarding roller 22, causing the fabric to be longitudinally compacted while it transits the confinement zone. The extent of compacting can be accurately controlled by controlling the respective surface speeds of the rollers 20, 22. To this end, the feed roller can be operated by a drive 26 (FIG. 3) and the retarding roller by a separate and independently controlled drive 27. To advantage, the retarding roller drive 27 may be associated with the feed roller drive 26 such that variations in speed of the feed roller are automatically translated to the retarding roller, while still enabling the speed of the retarding roller to be adjusted relative to the speed of the feed roller.

Figure 2:
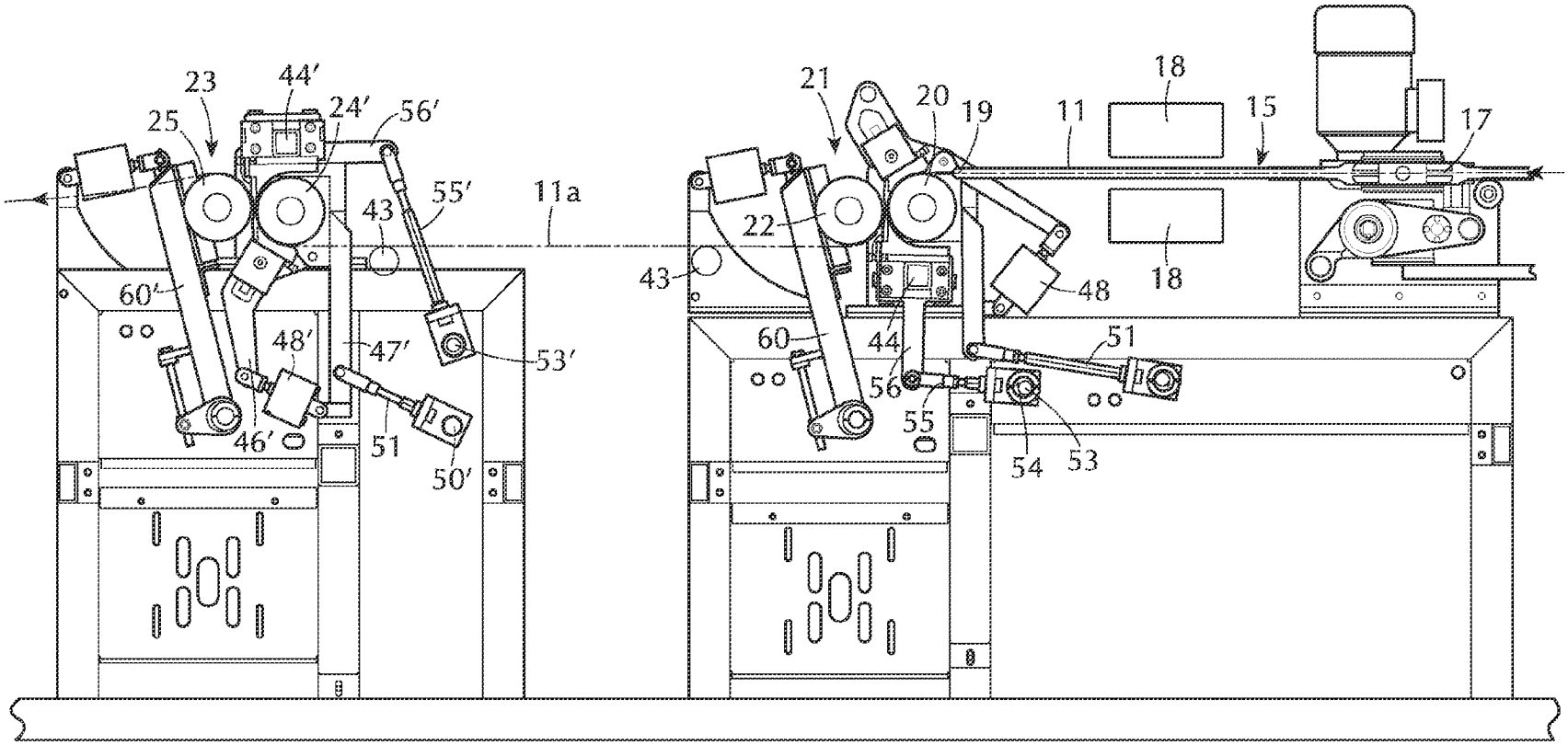
FIG. 2 is a side elevational view of the system of FIG. 1, which certain elements removed for clarity.
Figure 3:
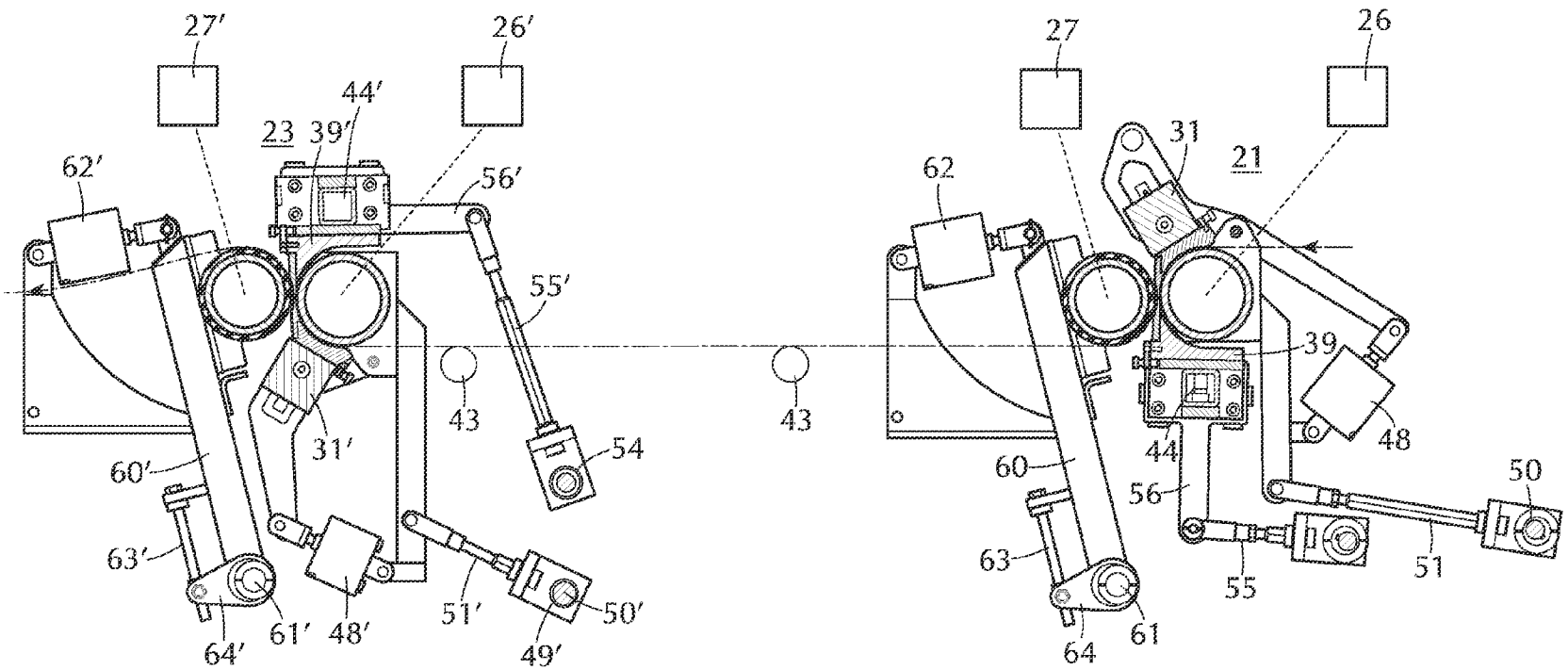
FIG. 3 is a side elevation, similar to FIG. 2, with certain elements removed and certain elements shown in section.
Figure 4:
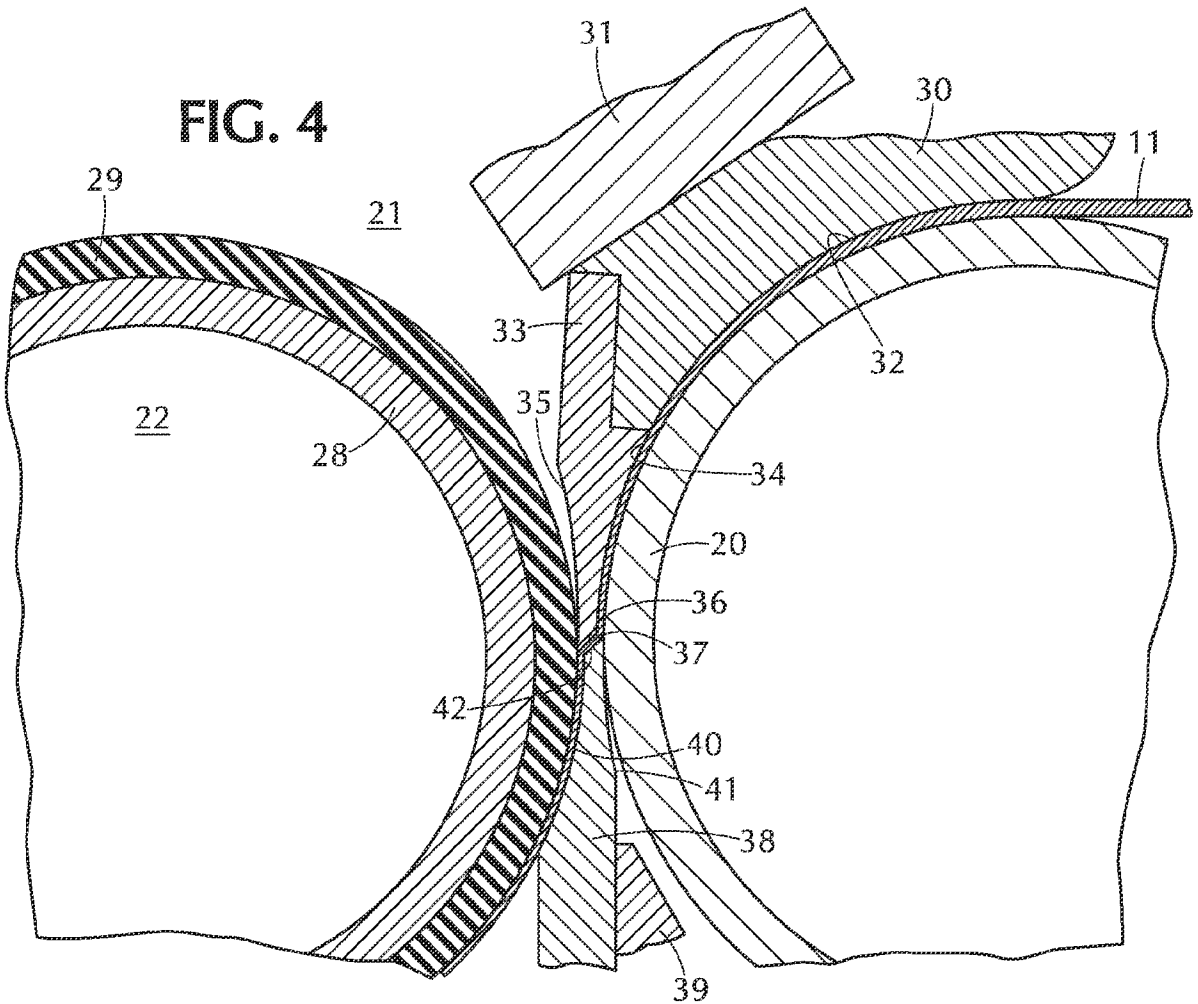
FIG. 4 is an enlarged, fragmentary cross sectional view of a compacting station of the type utilized in the process and system of the invention.

As shown in FIGS. 2 and 3, the components of the second compacting stage 23 are essentially identical to those of the first compacting stage, except that the orientation of the second stage 23 is reversed relative to the first stage 21. Accordingly the second stage feed roller 24 is contacted by the upper surface of the tubular fabric 11*a* while the lower surface of the fabric contacts the retarding roller 25. The various elements described with respect to the first stage, and shown in FIG. 4, are incorporated into the second compacting stage 23, many being designated by a primed reference number corresponding a reference numeral designating a first stage part. The arrangement is such that the fabric is acted upon in the second stage in substantially the same manner as in the first stage except for the reversal of orientation.

The respective feed and retarding rollers 24, 25 of the second compacting stage are independently speed controlled by drives 26', 27', with the retarding roller drive 27' being associated with the feed roller drive 26' such that changes in speed of the second stage feed roller 24 are automatically translated to the second stage retarding roller 25, while also accommodating independent control over the retarding roller 25 to vary its surface speed relative to that of the feed roller 24. In this respect the roller operating controls for the second stage can be the same as for the first stage.

Desirably, the surface speed of the second stage feed roller 25 is controlled to be substantially the same as the speed at which the partially compacted fabric exits from the surface of the first stage retarding roller 22, so that the partially compacted fabric is conveyed in a substantially tension-free manner between the first and second compacting stations 21, 23, preferably being supported in such conveyance by spaced apart idler rollers 43. Typically, the extent of compacting retained by the fabric, as it emerges from its confinement on the retarding roller by the retarding side blade, is somewhat less that would be indicated by merely comparing the ratio of the surface speeds of the feeding and retarding rollers 20, 22. Accordingly, the partially compacted fabric exits from the retarding roller 22 at a speed somewhat higher than the surface speed of the retarding roller. The surface speed of the second stage feed roller 25 is therefore regulated to a surface speed which is typically higher than the surface speed of the first stage retarding roller and substantially equal to the exit speed of the partially compacted fabric 11*a* discharged from the first compacting stage.

While the steam-moistened fabric is being carried through the compacting stages it is also subjected to heating. A particularly advantageous arrangement for effecting such heating is described in the Allison et al U.S. Pat. No. 6,047,483, the entire content of which is incorporated herein by reference. In the arrangement of the Allison et al '483 patent, a heat transfer liquid is heated, typically from a factory steam source, and caused to flow sequentially through a passage (not shown) in the shoe mounting bar 31, then through the feed roller 20, and finally through the hollow interior of a square bar 44 which is secured in heat-transfer contact with the shoe 39 and retarding-side blade 38. Most of the heat flows to the feed roller shoe 30 and feeding side blade 33, and to the feed roller 20, such that the fabric becomes uniformly heated to a desired temperature as is approaches the confinement zone 17, in which it is longitudinally compacted. A similar heating arrangement is incorporated in the second compacting stage. In the process of the invention, the temperature to which the feed rollers are heated for optimum performance can be held to a lower level. This results in a superior surface appearance of the fabric, more free of the shine or sheen, which is a characteristic of conventional processing because of its requirement for higher processing temperatures. Typically, steaming of the fabric between compacting stages is not necessary because the fabric retains adequate moisture from the steam applied directly in advance of the first stage.

Figure 5:
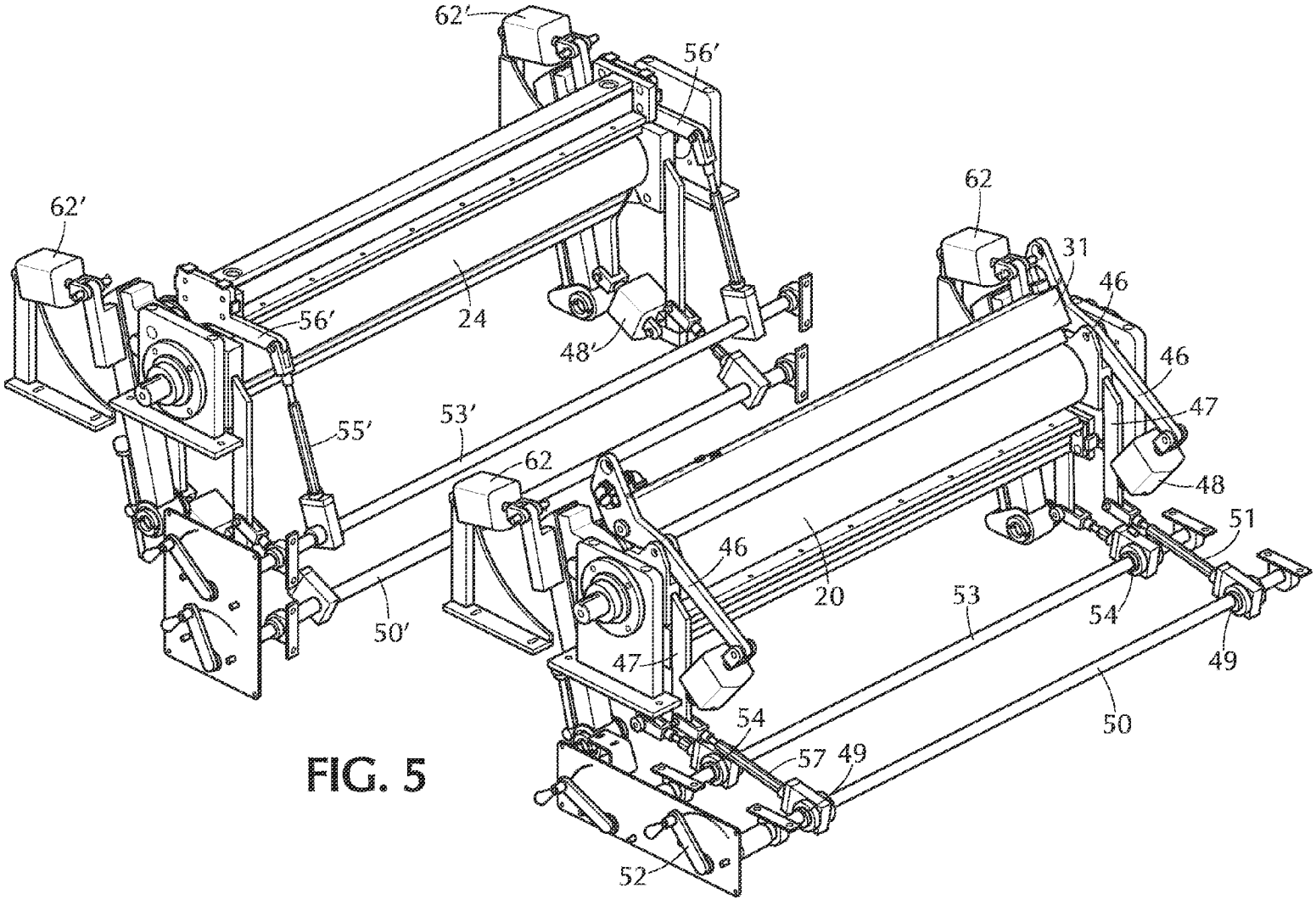
FIG. 5 is a perspective view from above showing details of first and second compacting stations incorporated in the system of FIG. 1.

Accurate positioning and adjustment of the principal components of each compacting stage are important in order to achieve uniform operating results extending over the full width of the fabric. To this end, each of the compacting stations incorporates mechanisms according to the Allison et al U.S. Pat. No. 5,655,275, the entire content of which is incorporated herein by reference. In this arrangement, the bar 31 and shoe 30 associated with the feed roller 20 are mounted on lever arms 45 (FIG. 5) mounted at opposite side of the machine and pivoted at 46 on support members 47. The support members 47 are in turn pivoted on the axis of the feed roller 20. Fixed stroke fluid actuators 48 connect the lever arms 45 to the supports, normally in a rigidly fixed relation. Precise adjustment of the upper or feed-side blade 33 is provided by eccentrics 49 at each side which are mounted on a transverse shaft 50 and connected to the supports 47 by adjustable linkages 51. Controlled rotation of the shaft 50 by an operator-controlled handle 52 serves to rock the supports 47 about the feed roller axis and enables extremely precise positioning of the of the feed-side blade 33. Gross opening movement of the blade 33, as for threading of a fabric section, inspection, cleaning, etc., is accomplished by retraction of the actuators 48.

Similar precise positioning of the lower or retarding-side blade 38, is managed by means of a transverse shaft 53 mounting eccentrics 54 and connected by adjustable linkages 55 to levers 56 (FIGS. 2, 3) fixed to the retarding shoe 39 at each side of the machine. The retarding shoe 39 and its supporting structure are pivoted at a point (not shown) slightly below the retarding side blade 38. Accordingly, the vertical position of the blade 38 is substantially fixed and the pivoting action provided by the levers 56 serves to adjustably move the tip of the blade 38 more or less horizontally, toward or away from the surface of the feed roller 20.

In the illustrated form of the invention, the retarding rollers 22, 25 are mounted on upright lever arms 60, 60' pivoted at 61, 61' in the machine frame. Fixed stroke actuators 62, 62' move the retarding rollers 22, 25 between operating and retracted positions, and adjusting screws 63, 63' associated with eccentrics 64, 64' provided for precise positioning of the rollers in their closed or working positions.

In a typical but non-limiting example of the practice of the process of the invention, a spread and steamed tubular knitted fabric is delivered to the first stage feed roller 20, which is set to run at 65 yards per minute. The retarding roller 22 is set to run at a considerably lower surface speed of 54.6 yards per minute. These settings result in approximately 10% compaction being imparted to the fabric, with a resulting fabric exit speed from the first stage of approximately 58.5 yards per minute. In the second stage, the feed roller 24 is set to run at a surface speed equal to the exit speed of the fabric from the first stage, or 58.5 yards per minute. This provides for a tension-free transfer of the fabric between the first and second stages. In the second stage, the retarding roller 25 is set to run at a surface speed of 49.1 yards per minute to yield a second stage compaction of approximately 10%, for a total retained compaction of approximately 19%. The resulting compacted fabric is significantly free of sheen and opposite side surface differences.

The improved surface appearance of the fabric is in part a result of the fact that the two-stage process according to the invention can be carried out at relatively lower feed roll temperatures than are normally required. Thus, in a typical operation, as described above, the feed rollers and the feeding and retarding side blades of both compacting stages are operated at a temperature of about 200° F. By comparison typical operating temperatures for a two-stage machine of the type shown in the Cohn et al '146 patent typically run 250° F.-275° F. for both the feed rollers, and the shoes. The retarding rollers typically are heated to around 300° F. In the new process and system, the retarding rollers are not heated at all, except indirectly and at a much lower temperature level, from the moving fabric and the ambient conditions.

By way of further non-limiting examples of fabrics processed according to the invention, a single Jersey fabric of about 5.2 oz. per square yard, was processed at a speed of 80 yards per minute, with 11% compaction in the first stage and 9% compaction in the second stage, for a total of 20% compaction. A single Jersey fabric of about 5.7 oz. per square yard, also processed at 80 yards per minute, was compacted 8% in each of the two stages for a total of 16%. A fleece fabric of about 6.0 oz. per square yard was processed at 66 yards per minute with 12% compaction at the first stage and 10% compaction at the second stage, for a total of 22% compaction. In all three of the foregoing examples, feeding roll and shoe temperatures were operated at 200° F.

The process of the invention achieves very surprising and unusually beneficial results in connection with the finishing of tubular knitted fabrics. Although in the individual compacting stages the opposite sides of the fabric are never in simultaneous contact with opposed feeding and retarding rollers at the same point, it nevertheless was discovered to be very important and surprisingly advantageous to utilize two compacting stations, each operating at a level well below its capacity to impart compacting to the fabric. By providing two compacting stations, and dividing the total compacting effort into two stages, in which the fabric receives substantially equal amounts of compacting by each of two reversely oriented sets of compacting rollers, a significantly higher degree of overall compacting can be imparted to the fabric while simultaneously achieving higher production rates and while also providing the finished fabric with a superior surface appearance. By way of example only, and not of limitation, fleece goods compacted in accordance with the process of the invention have been shown to have improved flame retardance, as a result of the uniformity of treatment on both surfaces of the fabric tube. At any given level of fabric compaction, a substantial improvement in production speeds is possible when utilizing the new process, as compared to conventional processing. In this respect, production speed increases of as much as 23% have been observed, and it is expected that even greater speed increases will be realized.

At any given production speed, the extent of compacting that can be imparted to the fabric by the new procedure, without fabric surface degradation and/or shade variation between sides is significantly greater than otherwise. Moreover, the resulting fabric has greater stability and less skew as compared to conventionally processed fabric. This has a direct economic benefit in increasing efficiencies of the subsequent cutting and sewing stages, in which the fabrics are converted into garments.

Among other things, the new compacting procedure can enable higher operating speeds in the preceding continuous drying operations and thus can speed up an entire production sequence. With current, conventional procedures, fabric processors, frequently introduce a fabric web into dryers with a considerable degree of overfeed. This enables some of the desired longitudinal shrinkage of the fabric to occur during the drying operations and correspondingly reduces the compacting effort required to be imparted by conventional compactor equipment during the finishing operations. However, the increased overfeed to the dryer equipment requires the dryer to be operated at lower production speeds than otherwise can be realized. With the system of the invention, on the other hand, all of the desired longitudinal shrinkage can easily be imparted by the compactor equipment while maintaining equal or superior fabric surface conditions. This enables the preceding drying operations to be carried out without excessive overfeed of the fabric, enabling optimum output speeds to be realized at the dryer.

The system of the present invention, in addition to enabling processing of the fabric at higher speeds for a given amount of compacting, is able to achieve these results while subjecting the fabric to significantly less heat than with conventional two stage systems. One benefit of the lower heat levels, combined with other factors, is the substantial elimination of surface sheen on the processed fabric, which is undesirable and lessens the quality of the fabric and of garments made therefrom. Additionally, even though a high level of compaction is imparted to the fabric, there is less hairiness on the surface, resulting in better flame retardance characteristics on sensitive fabrics, such as fleeces.

It should be understood, of course, that the specific embodiments of the invention herein illustrated and described are intended to be representative only, as various changes may be made therein within the clear teachings of the disclosure. Accordingly, reference should be made to the following appended claims in determining the full scope of the invention.

What is claimed is:

1. A method of imparting lengthwise compacting to tubular knitted fabric in which, a dry tubular knitted fabric is spread internally to a flat two-layer form of predetermined width having first and second layers, and is steamed while being spread, and the fabric is subjected to two successive mechanical compacting operations in succession, performed with two-roll compactors each having a feed roller and a retarding roller, with opposite sides of the fabric being reversely oriented with respect to the successive compacting operations, the improvement characterized by the spread and steamed fabric being advanced to bring the first layer of the fabric into contact with a surface of a first stage feed roller of a first stage compactor, with said first stage feed roller being driven at a controllable first surface speed to advance the fabric substantially at said first surface speed, redirecting the fabric out of contact with the surface of said first stage feed roller, advancing the fabric for a distance free of contact with feeding or retarding roller surfaces, and thereafter bringing the second layer of the fabric into contact with a surface of a first stage retarding roller of said first stage compactor, said first stage retarding roller being spaced from said first stage feed roller by a minimum distance that is substantially greater than a thickness of the two-layer fabric, such that directly opposed areas of the fabric on opposite sides thereof are not contacted simultaneously by said first stage feed roller and said first stage retarding roller, said first stage retarding roller being driven at a controllable second surface speed which is less than said first surface speed, closely confining the opposite sides of a portion of said fabric during transfer of said fabric portion across a space from said first stage feed roller to said first stage retarding roller and while said fabric portion is free of contact with either of said first stage rollers, whereby said fabric portion is caused to be compressed in a lengthwise direction of the fabric during said transfer, advancing the fabric from said first stage retarding roller to a second stage feed roller of a second stage compactor and bringing said second fabric layer into contact with a surface of said second stage feed roller, driving said second stage feed roller at a third surface speed substantially equal to an exit speed of partially compacted fabric leaving said first stage retarding roller, redirecting the partially compacted fabric out of contact with the surface of said second stage feed roller, advancing the fabric for a distance free of contact with feeding or retarding roller surfaces, and thereafter bringing the first layer of the fabric into contact with a surface of a second stage retarding roller of said second stage compactor said second stage retarding roller being spaced from said second stage feed roller by a minimum distance that is substantially greater than the thickness of the two-layer fabric, such that directly opposed areas of the fabric on opposite sides thereof are not contacted simultaneously by said second stage feed roller and said second stage retarding roller, said second stage retarding roller being driven at a controllable fourth surface speed which is less than said third surface speed, closely confining the opposite sides of a portion of said fabric during transfer of said fabric portion across a space from said second stage feed roller to said second stage retarding roller, and while said fabric portion is out of contact with either of said rollers, whereby said fabric portion is caused to be compressed in a lengthwise direction of the fabric during said transfer, conveying the compacted fabric from said second stage retarding roller and gathering the compacted fabric for further processing, and the respective first stage and second stage compacting operations being so controlled and carried out that not more than 60% of the total lengthwise compacting of the fabric is carried out in a single compacting stage.

2. The method of claim 1, wherein at least 50% of the total lengthwise compacting is carried out in said first compacting stage.

3. The method of claim 1, wherein substantially 50% of the total lengthwise compacting of the fabric is carried out in each of the two compacting stages.

4. The method of claim 1, wherein the first and second stage feed rollers are heated to a temperature not substantially in excess of 200° F.

5. The method of claim 1 wherein (a) said fabric portions are closely confined during transfer between said feed roller and said retarding roller of said first and second stages by opposed feeding side and retarding side blades each having an end portion interposed between the feed roller and retarding roller of the respective first and second stages in a region in which the respective feed rollers and retarding rollers most closely approach each other, (b) opposed end surfaces of said blades being positioned to define first and second stage confinement zones, said confinement zones being positioned in spaces between respective feed rollers and retarding rollers and extending in a direction from said feed rollers toward said retarding rollers.

6. The method of claim 5, wherein said first and second stage feed rollers and said feeding side and retarding side blades are heated to a temperature not substantially in excess of 200° F.

7. The method of claim 1, wherein said fabric is subjected to a drying operation in advance of being spread and steamed, and said fabric is fed to said drying operation with minimal overfeed to optimize the production speed of said drying operation.

8. An apparatus for imparting lengthwise compacting to tubular knitted fabric, which comprises, a spreader for receiving dry tubular fabric and distending it laterally to a flat two-layer form having first and second flat layers and to a predetermined width, steam elements positioned adjacent opposite flat sides of said tubular fabric direct steam onto the surfaces of the fabric, a first compacting stage comprising a first stage feed roller positioned adjacent a discharge end of said spreader for receiving fabric therefrom with a first layer of said fabric in contact with an outer surface of said first stage feed roller, and a first stage retarding roller mounted parallel to said first stage feed roller and positioned closely adjacent thereto, said first stage retarding roller being positioned to have contact with a second layer of said fabric, said first stage feed roller being spaced from said first stage retarding roller by a minimum distance that is substantially greater than a thickness of the two-layer fabric, such that directly opposed areas of the fabric on opposite sides thereof are not contacted simultaneously by said first stage feed roller and said first stage retarding roller, first stage feeding side and retarding side blade elements forming part of said first compacting stage, arranged in opposed relation and each having an end portion projecting into the space between said first stage feed and retarding rollers in regions in which said rollers most closely approach each other, opposed ends of said first stage blade elements forming a confining path extending away from the surface of said feed roller and toward the surface of said retarding roller to guide and confine fabric portions out of contact with either of said rollers during transfer of said fabric portions from said first stage feed roller to said first stage retarding roller and defining a first stage compressive shrinkage zone to enable lengthwise compressive shrinkage of said fabric, controllable first stage drives for said first stage feed and retarding rollers driving said first stage feed roller to have a controllable first surface speed and driving said first stage retarding roller to have a second surface speed controllably slower than said first surface speed, causing said fabric portions to be controllably compressed in a lengthwise direction while confined within said first stage compressive shrinkage zone during transfer of said fabric portions from said feed roller to said retarding roller, a second compacting stage arranged in a reverse orientation with respect to said first compacting stage and comprising a second stage feed roller mounted parallel to said first stage rollers and positioned to receive partially processed fabric discharged from said first stage retarding roller, and a second stage retarding roller mounted parallel to said second stage feed roller and positioned closely adjacent thereto, said second stage feed roller and second stage retarding roller being positioned such that an outer surface of said second stage feed roller is contacted by the second layer side of said fabric, and an outer surface of said second stage retarding roller is contacted by the first layer of said fabric, said second stage feed roller being spaced from said second stage retarding roller by a minimum distance that is substantially greater than a thickness of the two-layer fabric, such that directly opposed areas of the fabric on opposite sides thereof are not contacted simultaneously by said second stage feed roller and said second stage retarding roller, second stage feeding side and retarding side blade elements forming part of said second compacting stage, arranged in opposed relation and each having an end portion projecting into the space between said second stage feed and retarding rollers in regions in which said rollers most closely approach each other, opposed ends of said second stage blade elements forming a confining path extending away from the surface of said second stage feed roller and toward the surface of said second stage retarding roller to guide and confine fabric portions out of contact with either of said rollers during transfer of said fabric portions from said second stage feed roller to said second stage retarding roller and defining a second stage compressive shrinkage zone to enable additional lengthwise compressive shrinkage of said fabric, and controllable second stage drives for said second stage rollers driving said second stage feed roller to have a controllable third surface speed and driving said second stage retarding roller to have a fourth surface speed controllably slower than said third surface speed, causing said fabric portions to be controllably compressed in a lengthwise direction while confined within said second stage compressive shrinkage zone during transfer of said fabric portions from said feed roller to said retarding roller, the respective first and second stage drives being controllable to limit the lengthwise compacting of the fabric in a single compacting stage to not more than 60% of the total.

9. The apparatus of claim 8, further including a support structure positioned between said first and second compacting stages to support said fabric in a substantially tension-free manner during a transit of the fabric from the first compacting stage to the second compacting stage.

10. The apparatus of claim 8, further including means for heating said feed rollers and said blade elements to a temperature level not substantially greater than 200° F.

11. The apparatus of claim 8, wherein said first and second stage drives are controllable such that approximately 50% of the lengthwise compressive shrinkage of the fabric in imparted at each of said stages.

* * * * *